US005391309A

United States Patent [19]

Brewster et al.

[11] Patent Number: 5,391,309

[45] Date of Patent: Feb. 21, 1995

[54] METHOD OF PREPARING HIGH DROPPING POINT LITHIUM COMPLEX SOAP GREASES

[75] Inventors: Phillip W. Brewster, Camlachie; A. Gordon Alexander, Sarnia; Terrance O. Brown, Corunna, all of Canada

[73] Assignee: Exxon Research and Engineering Company, Florham Park, N.J.

[21] Appl. No.: 187,271

[22] Filed: Jan. 24, 1994

Related U.S. Application Data

[63] Continuation of Ser. No. 987,523, Dec. 8, 1992, abandoned, which is a continuation of Ser. No. 803,816, Dec. 9, 1991, abandoned.

[51] Int. Cl.[6] ..... C10M 117/04; C10M 117/06

[52] U.S. Cl. ..... 252/41; 252/18; 252/25; 252/42.1

[58] Field of Search ..... 252/41, 18, 25, 42.1

[56] References Cited

U.S. PATENT DOCUMENTS

| | | | |
|---|---|---|---|
| 3,681,242 | 2/1974 | Gilani et al. | 252/41 |
| 3,791,973 | 2/1974 | Gilani et al. | 252/41 |
| 4,435,299 | 3/1984 | Carley et al. | 252/41 |
| 4,444,669 | 4/1984 | Wittse et al. | 252/42.1 |
| 4,582,619 | 4/1986 | Carley et al. | 252/41 |
| 4,597,881 | 7/1986 | Iseya et al. | 252/41 |

*Primary Examiner*—Prince Willis, Jr.
*Assistant Examiner*—Alan D. Diamond
*Attorney, Agent, or Firm*—James H. Takemoto

[57] ABSTRACT

A high dropping point lithium complex soap grease is prepared by dissolving a monocarboxylic fatty acid and a dicarboxylic acid together in oil at a temperature above the boiling point of water and then neutralizing the resulting oil-acid mixture by adding a concentrated aqueous solution of lithium hydroxide monohydrate.

9 Claims, No Drawings

METHOD OF PREPARING HIGH DROPPING POINT LITHIUM COMPLEX SOAP GREASES

This application is a Rule 60 Continuation of U.S. Ser. No. 987,523, filed Dec. 8, 1992, (abandoned) which is a Rule 60 Continuation of U.S. Ser. No. 803,816, filed Dec. 9, 1991, (abandoned).

BACKGROUND OF THE INVENTION

1. Field of the Invention

This invention concerns the preparation of a lithium complex soap grease having a high dropping point.

2. Description of Related Art

Various batch processes have been suggested for preparing lithium complex soap thickened greases. For example, U.S. Pat. No. 2,898,296 discloses a process in which the dicarboxylic acid is converted to an ester prior to reaction with lithium hydroxide. As another example, U.S. Pat. No. 2,940,930 discloses a process wherein a polyhydric alcohol or glycol is added to the monobasic or dibasic acid mixture before lithium hydroxide is added. In U.S. Pat. No. 3,681,242, the monocarboxylic acid and the dicarboxylic acid components are neutralized together, but the process requires two distinct heating steps following neutralization. In yet another example, U.S. Pat. No. 3,791,973 discloses a process which requires separate neutralization and heating steps for the monocarboxylic fatty acid and the dicarboxylic acid components. However, the separate neutralization steps result in extended production times. More recently, U.S. Pat. Nos. 4,435,299 and 4,582,619 disclose a single stage batch process that requires direct neutralization of the acids and one heating stage thereafter, but with carefully controlled alkali addition in which the temperature must be maintained below the boiling point of water during preparation of the grease. However, the slow rate of alkali addition also results in extended production times.

Continuous processes for manufacturing lithium complex soap thickened greases are also known. For Example, U.S. Pat. No. 4,444,669 discloses a continuous process for preparing a high dropping point lithium complex soap grease in which the oil, acids, and base are reacted at the same time and the temperature is maintained above the boiling point of water during neutralization. However, continuous processes have the disadvantage of less operational flexibility than batch processes. For this reason, almost all existing grease plants and equipment are for batch processes.

Accordingly, there is a need for a method of preparing a high dropping point lithium complex soap grease that utilizes existing grease plant equipment, but reduces the production time associated with batch processes.

SUMMARY OF THE INVENTION

In response to this need, we have discovered a single stage batch method of preparing a lithium complex soap grease having a dropping point of at least 260° C. which comprises the steps of:

(a) dissolving a $C_{12}$ to $C_{24}$ hydroxy fatty acid and a $C_2$ to $C_{12}$ aliphatic dicarboxylic acid in a lubricating oil to form an oil-acid mixture, the amount of lubricating oil added ranging from about 20 to about 90 wt. % of the total amount oil present in the finished grease composition, (b) adjusting the temperature of the oil-acid mixture to a temperature above the boiling temperature of water, (c) adding an aqueous solution of lithium hydroxide monohydrate to the oil-acid mixture formed, the amount of lithium hydroxide monohydrate being slightly in excess of that required to neutralize the acids present in the oil-acid mixture, (d) maintaining the reaction conditions for a period of time sufficient to obtain substantially complete neutralization of the acids and lithium hydroxide monohydrate, (e) dehydrating the mixture formed in step (d), (f) heating the mixture until it is uniformly at a temperature of from about 200° to about 220° C., (g) cooling the mixture from step (f) to a temperature of about 200° C. or below, and (h) incorporating the remainder of the lubricating oil into the mixture.

DETAILED DESCRIPTION OF THE INVENTION

A lubricating oil, a hydroxy fatty acid, a dicarboxylic fatty acid, and lithium hydroxide monohydrate are required to prepare the high dropping point grease of this invention.

A wide variety of lubricating oils can be used to prepare the grease of this invention. For example, the lubricating oil base can be any of the conventionally used mineral oils, synthetic hydrocarbon oils, or synthetic ester oils, depending upon the particular grease being prepared. In general these lubricating oils will have a viscosity in the range of from about 5 to about 10,000 cSt at 40° C., although typical applications will require an oil having a viscosity ranging from about 10 to about 1,000 cSt at 40° C. Mineral lubricating oil base stocks used preparing the greases can be any conventionally refined base stocks derived from paraffinic, naphthenic, and mixed base crudes. Synthetic lubricating oils that can be used include esters of dibasic acids, such as di-2-ethylhexyl sebacate, esters of glycols such as a $C_{13}$ oxo acid diester of tetraethylene glycol, or complex esters such as one formed from I mole of sebacic acid and 2 moles of tetraethylene glycol and 2 moles of 2-ethylhexanoic acid. Other synthetic oils that can be used include synthetic hydrocarbons such as polyalphaolefins; alkyl benzenes, e.g. alkylate bottoms from the alkylation of benzene with tetrapropylene, or the copolymers of ethylene and propylene; silicon oils, e.g. ethyl phenyl polysiloxanes, methyl polysiloxanes, etc.; polyglycol oils, e.g. those obtained by condensing butyl alcohol with propylene oxide; carbonate esters, e.g. the product of reacting $C_8$ oxo alcohol with ethyl carbonate to form a half ester followed by reaction of the latter with tetraethylene glycol, etc. Other suitable synthetic oils include the polyphenyl ethers, e.g. those having from about 3 to 7 ether linkages and about 4 to 8 phenyl groups. (See U.S. Pat. No. 3,424,678, column 3.) The amount of lubricating oil in the grease can also vary broadly, but, typically, will range from about 50 to about 98 wt. %, preferably from about 75 to about 95 wt. %, of the finished grease.

The particular hydroxy fatty acid employed will have from about 12 to 24, or more usually about 16 to 20, carbon atoms and will preferably be an hydroxy stearic acid, e.g., 9-hydroxy, 10-hydroxy, or 12-hydroxystearic acid, more preferably the latter. Ricinoleic acid, which is an unsaturated form for 12-hydroxy stearic acid (having a double bond in the 9-10 position), can also be used. Other hydroxy fatty acids include 12-hydroxy behenic acid and 10-hydroxy palmitic acid.

The particular dicarboxylic acid used will have from 2 to 12, preferably from 4 to 12 and most preferably from 6 to 10, carbon atoms. Suitable dicarboxylic acids include oxalic, malonic, succinic, glutaric, adipic, suberic, pimelic, azelaic, dodecanedioic, and sebacic acids. Sebacic acid and azelaic acid are particularly preferred. The proportion of dicarboxylic acid to hydroxy fatty acid in the lithium complex grease should range from about 0.2 to about 1.0, preferably from about 0.5 to about 0.8, moles of dicarboxylic acid per mole of hydroxy fatty acid.

The total soap content of the grease of this invention should be sufficient to thicken the grease to the desired consistency. Normally, the total soap content will range from about 1 to about 30 wt. % of the grease. For most purposes, the total soap content should be between about 5 to about 20 wt. %, preferably between about 10 to about 15 wt. %, of the grease.

In preparing the grease of this invention, the ingredients described above may be mixed or blended in any number of ways that can readily be selected by one skilled in the art, provided the mixing or blending is done in a system or reaction zone capable of maintaining the temperature above the boiling point of water (i.e., a pressure vessel or closed system). This allows operation at a higher temperature resulting in faster production times. A particularly preferred reaction zone is a Stratco contacter. The ingredients are usually agitated or blended during preparation.

According to this invention, a $C_{12}$ to $C_{24}$ hydroxy fatty acid and a $C_2$ to $C_{12}$ aliphatic dicarboxylic acid are dissolved by mixing and heating both acids in about 20 to about 90 wt. %, preferably in about 40 to about 60 wt. %, but generally in the order of about 50 wt. %, of the total amount of the lubricating oil used to prepare the grease. The temperature necessary for dissolution of the acids should be greater than the boiling point of water. Usually this temperature will range from about 101° to about 180° C., preferably from about 105° to about 150° C., and most preferably from about 110° to about 120° C.

Once the acids are dissolved in the oil, a concentrated aqueous solution of lithium hydroxide monohydrate is then added to the oil-acid mixture. The lithium hydroxide monohydrate should be added over a period of time to facilitate the formation of a desired product. In broadest terms, at least 30 minutes is required for alkali addition, with typical times ranging from about 30 minutes to about 4 hours, preferably from about 30 minutes to about 3 hours, and most preferably from about 30 minutes to about 2 hours. Normally, the amount of lithium hydroxide monohydrate added is slightly in excess of the stoichiometric amount theoretically required for complete neutralization of the acids. Typically, this excess will range from about 2 to about 5 wt. %. During alkali addition, the temperature should be mantained at essentially the same temperature as the acid dissolution described above.

After lithium hydroxide addition is complete, the mixture is maintained at a temperature above the boiling temperature of water (i.e., greater than 100° C. as above, most preferably between about 110° and about 120° C.) until neutralization is substantially complete, which may take from about 15 to about 45 minutes and more likely about 30 minutes.

Following neutralization, the oil and lithium complex soap mixture are then substantially dehydrated by heating the mixture to from about 110° to about 180° C. After dehydration, the temperature of the grease mixture is further raised until the mixture is uniformly at a temperature of from about 200° to about 220° C. The temperature is maintained within this range for from about 15 to about 60 minutes, and generally about 30 minutes, to ensure optimum soap crystallization and improved yields. This latter increase in temperature (or "cookout") is effected as rapidly as possible to save time and to minimize oxidation.

During the temperature increase resulting in the dehydration and "cookout" steps just described, at least 50%, preferably at least 95%, of the water vapor formed during the heating steps is removed to further facilitate soap crystallization. Removal can be effected by any suitable means such as venting the reaction zone to the atmosphere.

The mixture is then cooled (e.g., by an external cooling means such as an insulating jacket or heat exchanger) to a temperature of about 200° C. or below as rapidly as possible. This cooling may be aided by incorporating a portion of the remaining quantity of lubricating oil into the mixture. When the temperature has been reduced to below say about 150° C., the grease may be passed through a conventional grease mill, if desired, to obtain a somewhat improved yield and appearance. Suitable grease mills include a Morehouse mill, a Charlotte mill, and a Gaulin homogenizer. However, milling is not necessary for the preparation of a satisfactory grease.

If desired, conventional grease additives could also be introduced into the grease. Such additives include, but are not limited to, anticorrosive agents, pour point depressants, tackiness agents, viscosity improvers, oxidation inhibitors, dyes, and the like. Any remaining lubricating oil can also be added as well to facilitate obtaining a grease having the desired consistency. Although not necessary, the grease could be passed through a grease mill at this point as well.

The multipurpose grease of this invention has a variety of uses and may be suitably employed in essentially any application requiring a high dropping point grease, including use in wheel bearing, industrial equipment, and the like.

This invention will be further understood by reference to the following example, which includes a preferred embodiment of this invention.

Example

A high dropping point lithium complex grease was prepared from the following ingredients:

| Ingredients | lbs |
|---|---|
| 500 SE Coastal Pale | 8602 |
| Canthus 1000 | 5967 |
| 12 Hydroxy Stearic Acid | 1550 |
| Azelaic Acid | 387 |
| Lithium Hydroxide Monohydrate | 401 |
| Additives | 666 |

The 12 hydroxy stearic acid (1550 lbs) and azelaic acid (387 lbs) were mixed with 6358 lbs of 500 SE Coastal Pale in a Stratco contactor at ambient conditions for about 30 minutes. The contactor was then closed and the mixture heated to a temperature between 110° and 115° C. for about 40 minutes. After the acids were essentially dissolved in the oil, a concentrated lithium hydroxide monohydrate solution (401 lbs of $LiOH.H_2O$ in 150 gal water) was added over approximately 90 minutes to effect neutralization. Following neutralization, the mixture was dehydrated by raising the temperature to about 180° C., and then to about 200° C. for "cookout". During the dehydration and "cookout", a major portion of water vapor formed was removed by venting the contactor so as to maintain a pressure of about 90 psi. The contactor was then depressurized and the mixture transferred to a conventional stir-down kettle where the remaining base oils and additives were added to form a lithium complex grease product having the following inspections:

| Penetration, mm/10 @ 25° C. | |
|---|---|
| Undisturbed | 251 |
| × 60 | 284 |
| × 100,000 | 315 |
| Dropping Point, °C. | 277 |
| Appearance | Smooth |

What is claimed is:

1. A single stage method for preparing a lithium complex soap grease having a dropping point of at least 260° C. which consists essentially of the steps of:

(a) dissolving a $C_{12}$ to $C_{24}$ hydroxy fatty acid and a $C_2$ to $C_{12}$ aliphatic dicarboxylic acid in a lubricating oil to form an oil-acid mixture in a pressure vessel at a temperature of from about 105° C. to about 150° C., the amount of lubricating oil added ranging from about 20 to about 90 wt. % of the total amount oil present in the finished grease composition, (b) adding an aqueous solution of lithium hydroxide monohydrate to the oil-acid mixture formed at a temperature of from about 105° C. to about 150° C., the amount of lithium hydroxide monohydrate being slightly in excess of that required to neutralize the acids present in the oil-acid mixture, (c) maintaining the reaction conditions at a temperature of from about 105° C. to about 150° C. for a period of time sufficient to obtain essentially complete neutralization of the acids and lithium hydroxide monohydrate, (d) dehydrating the mixture formed in step (c) at a temperature of from about 110° C. to about 180° C., (e) heating the mixture until it is uniformly at a temperature of from about 200° to about 220° C., (f) maintaining the temperature in step (e) for from about 15 to about 60 minutes, (g) cooling the mixture from step (f) to a temperature of about 200° C. or below, and (h) incorporating the remainder of the lubricating oil into the mixture.

2. The method of claim 1 wherein one or more conventional grease additives are incorporated into the grease following step (g).

3. The method of claim 1 which also comprises milling the grease after step (h).

4. The method of claim 1 wherein the hydroxy fatty acid has from 16 to 20 carbon atoms.

5. The method of claim 4 wherein the aliphatic dicarboxylic acid has from 6 to 10 carbon atoms.

6. The method of claim 4 wherein the hydroxy fatty acid is 12-hydroxy stearic acid.

7. The method of claim 6 wherein the aliphatic dicarboxylic acid is azelaic acid.

8. The method of claim 1 wherein the moles of dicarboxylic acid to the moles of hydroxy fatty acid in step (a) ranges from about 0.2 to about 1.

9. The method of claim 1 wherein at least 50% of the water vapor formed during steps (d) and (e) is removed.

* * * * *